US009664166B2

(12) United States Patent
Nagakura et al.

(10) Patent No.: US 9,664,166 B2
(45) Date of Patent: May 30, 2017

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Keisuke Nagakura, Anjo (JP); Toshitake Sasaki, Okazaki (JP); Kazuya Miyaji, Okazaki (JP); Takashi Suzuki, Miyoshi (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 121 days.

(21) Appl. No.: 14/818,377

(22) Filed: Aug. 5, 2015

(65) Prior Publication Data

US 2016/0040617 A1 Feb. 11, 2016

(30) Foreign Application Priority Data

Aug. 8, 2014 (JP) ..... 2014-162538

(51) Int. Cl.

| | |
|---|---|
| ***F02D 41/38*** | (2006.01) |
| ***F02M 59/20*** | (2006.01) |
| ***F02D 41/22*** | (2006.01) |
| ***F02D 41/30*** | (2006.01) |

(Continued)

(52) U.S. Cl.

CPC ..... *F02M 59/20* (2013.01); *F02D 41/222* (2013.01); *F02D 41/3094* (2013.01); *F02D 41/042* (2013.01); *F02D 41/062* (2013.01); *F02D 41/3854* (2013.01); *F02D 2041/223* (2013.01);

(Continued)

(58) Field of Classification Search

CPC ..... F02D 41/38; F02D 41/389; F02D 41/222; F02D 41/3094; F02D 41/042; F02D 41/062; F02D 2200/0602; F02D 2041/223; F02D 2041/3881; F02M 59/20

See application file for complete search history.

(56) References Cited

U.S. PATENT DOCUMENTS 4,275,693 A * 6/1981 Leckie ..... F02M 51/0617 123/447
6,871,633 B1 * 3/2005 Date ..... F02D 33/006 123/445

(Continued)

FOREIGN PATENT DOCUMENTS

JP 2013-068127 A 4/2013

*Primary Examiner* — Hieu T Vo

(74) *Attorney, Agent, or Firm* — Andrews Kurth Kenyon LLP

(57) ABSTRACT

An internal combustion engine includes a port injection valve and a feed pump that pressurizes the fuel. An engine ECU performs a stuck abnormality diagnosis of the fuel pressure sensor based on detection values of the fuel pressure sensor in first processing and second processing. The first processing includes setting a target pressure of the fuel in the storage section to a first pressure, and detecting a pressure of the fuel with the fuel pressure sensor. The second processing includes setting the target pressure of the fuel in a low-pressure delivery pipe to a second pressure lower than the first pressure, and detecting a pressure of the fuel. The engine ECU causes the first processing to be performed in response to a start signal that starts an internal combustion engine, and causes the second processing to be performed subsequent to the first processing.

5 Claims, 6 Drawing Sheets

(51) Int. Cl.
*F02D 41/04* (2006.01)
*F02D 41/06* (2006.01)

(52) U.S. Cl.
CPC ..... *F02D 2041/3881* (2013.01); *F02D 2200/0602* (2013.01)

(56) References Cited

U.S. PATENT DOCUMENTS 7,213,584 B2 * 5/2007 Ohhashi ..... F02D 41/266 123/519
9,038,489 B2 * 5/2015 Jackson ..... F02M 25/0809 73/114.39

* cited by examiner

CONTROL DEVICE FOR INTERNAL COMBUSTION ENGINE

This nonprovisional application is based on Japanese Patent Application No. 2014-162538 filed on Aug. 8, 2014, with the Japan Patent Office, the entire contents of which are hereby incorporated by reference.

BACKGROUND OF THE INVENTION

Field of the Invention

This invention relates to a control device for an internal combustion engine, and particularly to a control device for an internal combustion engine including port injection valves that inject fuel into an intake passage.

Description of the Background Art

Japanese Patent Laying-Open No. 2013-068127 discloses a control device to be applied to an internal combustion engine including a fuel pump and a fuel pressure sensor that detects a supply pressure of fuel to be supplied to port injection valves from the fuel pump. The control device outputs an amount of operation of the fuel pump in accordance with a detection value of the fuel pressure sensor.

This control device changes, for a diagnosis of the fuel pressure sensor, the amount of operation of the fuel pump in a direction of increasing the supply pressure, and determines the presence or absence of a failure in the fuel pressure sensor based on the detection value of the fuel pressure sensor at that time.

A failure diagnosis of the fuel pressure sensor is performed as follows. The drive duty of the fuel pump is increased to a diagnostic duty to thereby increase the fuel pressure to a valve opening pressure of the relief valve. If the fuel pressure sensor at that time has not detected a pressure around the valve opening pressure, it is determined that the fuel pressure sensor is in an abnormal state.

The control device described in the above-described document performs an abnormality diagnosis of the fuel pressure sensor when there is an increase in deviation in air-fuel ratio. It is, however, desirable to detect an abnormality in the fuel pressure sensor before the deviation in air-fuel ratio due to the abnormality in the fuel pressure sensor actually continues.

Further, although the control device described in the above-described document checks whether the fuel pressure sensor detects a pressure around the valve opening pressure of the relief valve, it is more preferred to check the performance of the fuel pressure sensor in further detail. For example, in order to check whether the detection value of the fuel pressure sensor changes, it is necessary to check detection values of the fuel pressure sensor at at least two pressures. This failure detection to check whether the detection value of the fuel pressure sensor has not become a fixed value is referred to as the "stuck detection".

Although it is preferred to perform the stuck detection before the influence of an actual failure becomes serious, results of experiments conducted by the inventors of this application have shown that in order to complete the stuck detection at an early stage, it is necessary to sufficiently consider with what timing and what pressure conditions the stuck detection is to be performed.

SUMMARY OF THE INVENTION

An object of this invention is to provide a control apparatus for an internal combustion engine that allows the stuck detection of the fuel pressure sensor to be completed at an early stage.

This invention relates to a control device for an internal combustion engine. The internal combustion engine controlled by the control device includes a port injection valve that injects fuel into an intake passage, a storage section that stores the fuel to be injected from the port injection valve, and a feed pump that pressurizes and supplies the fuel to the storage section. The control device includes a fuel pressure sensor that detects a pressure of the fuel stored in the storage section, and a control unit that controls the feed pump based on a detection value of the fuel pressure sensor, and performs an abnormality diagnosis of the fuel pressure sensor based on a detection value of the fuel pressure sensor when a target pressure of the fuel stored in the storage section is changed. The control unit is configured to cause first processing to be performed in response to a start signal that starts the internal combustion engine, for changing the target pressure, and cause the second processing to be performed subsequent to the first processing. The first processing includes setting the target pressure of the fuel in the storage section to a first pressure, pressurizing the fuel with the feed pump, and detecting a pressure of the fuel with the fuel pressure sensor. The second processing includes setting the target pressure of the fuel in the storage section to a second pressure lower than the first pressure, causing the fuel to be pressurized with the feed pump and reducing the pressure of the fuel by injection from the port injection valve of the internal combustion engine, and detecting a pressure of the fuel with the fuel pressure sensor.

The storage section that stores the pressurized fuel is basically in a sealed state while the internal combustion engine is shut down. While the internal combustion engine is shut down, fuel exchange involving the discharge of the fuel from the port injection valve and the supply of fresh fuel from the feed pump does not occur in the storage section. The fuel confined within the storage section expands due to the influence of heat from the internal combustion engine, and the pressure of the fuel increases. Thus, while the internal combustion engine is shut down, the fuel pressure supplied to the fuel pressure sensor is not constant because it is influenced by the temperature of the internal combustion engine. For example, in a vehicle that stops idling while it is stopped to wait for the traffic signal, for example, or in a vehicle such as a hybrid vehicle in which the operation of the internal combustion engine may be shut down during running, the temperature of the internal combustion engine during shutdown is variable, and the fuel pressure tends to vary. In such a situation, if the stuck detection of the fuel pressure sensor is attempted by changing the fuel pressure from a low pressure to a high pressure, it is necessary to reduce the fuel pressure to a low pressure once, which is sometimes time-consuming.

In the above-described configuration, the stuck detection is performed by setting the target pressure in the second processing subsequent to the first processing to be lower than the target pressure in the first processing. Therefore, even if the initial fuel pressure is varying due to the influence of the temperature of the internal combustion engine, this influence may not be considered. Hence, the stuck detection can be readily completed at an early stage.

Preferably, the internal combustion engine is mounted on a hybrid vehicle configured to be capable of running while the internal combustion engine is shut down. The start signal includes a signal generated when the internal combustion engine in a shutdown state is started while the vehicle is running.

The above-described configuration increases, in a hybrid vehicle, the possibility of ensuring the chance of performing the stuck detection a plurality of times at an early stage during one run.

More preferably, the control unit causes the internal combustion engine to operate in the second processing, and once the control unit initiates the first processing in response to a start command, the control unit prohibits shutdown of the internal combustion engine until the second processing is completed.

In a hybrid vehicle, during normal running, the internal combustion engine may be frequently operated or shut down for improved fuel efficiency. Since the fuel pressure is reduced mainly by injection of the fuel through the port injection valve, the pressure cannot be reduced if the internal combustion engine is shut down. Thus, the fuel pressure cannot be set freely, and the stuck detection cannot be performed. In the above-described configuration, once the stuck detection processing is initiated, shutdown of the internal combustion engine is prohibited until the processing is completed. This prevents an interruption of the stuck detection once the stuck detection is initiated. Therefore, the stuck detection can be performed reliably in a hybrid vehicle.

More preferably, after start of the vehicle, and after the control device has performed the first processing and the second processing in response to the start signal a number of times required for the abnormality diagnosis of the fuel pressure sensor, the control device does not perform the first processing even if the start signal is detected.

In the first processing, a fuel pressure higher than that used during normal running is generated in the feed pump. It is more advantageous not to perform this processing, where not required, in terms of improving the fuel efficiency. In the above-described configuration, the first processing is not performed after the stuck detection has been performed a required number of times. This is advantageous in terms of improving the fuel efficiency.

Preferably, the internal combustion engine further includes an in-cylinder injection valve that injects the fuel into a cylinder, a high-pressure storage section that stores the fuel to be injected from the in-cylinder injection valve, and a high-pressure pump that pressurizes and supplies the fuel to the high-pressure storage section, wherein a pressure of the storage section is set to be lower than a pressure of the high-pressure storage section.

The above-described configuration allows the stuck detection of a fuel pressure of the port injection valve to be completed at an early stage, in an internal combustion engine that separately uses the two injection valves, i.e., the in-cylinder injection valve and the port injection valve.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
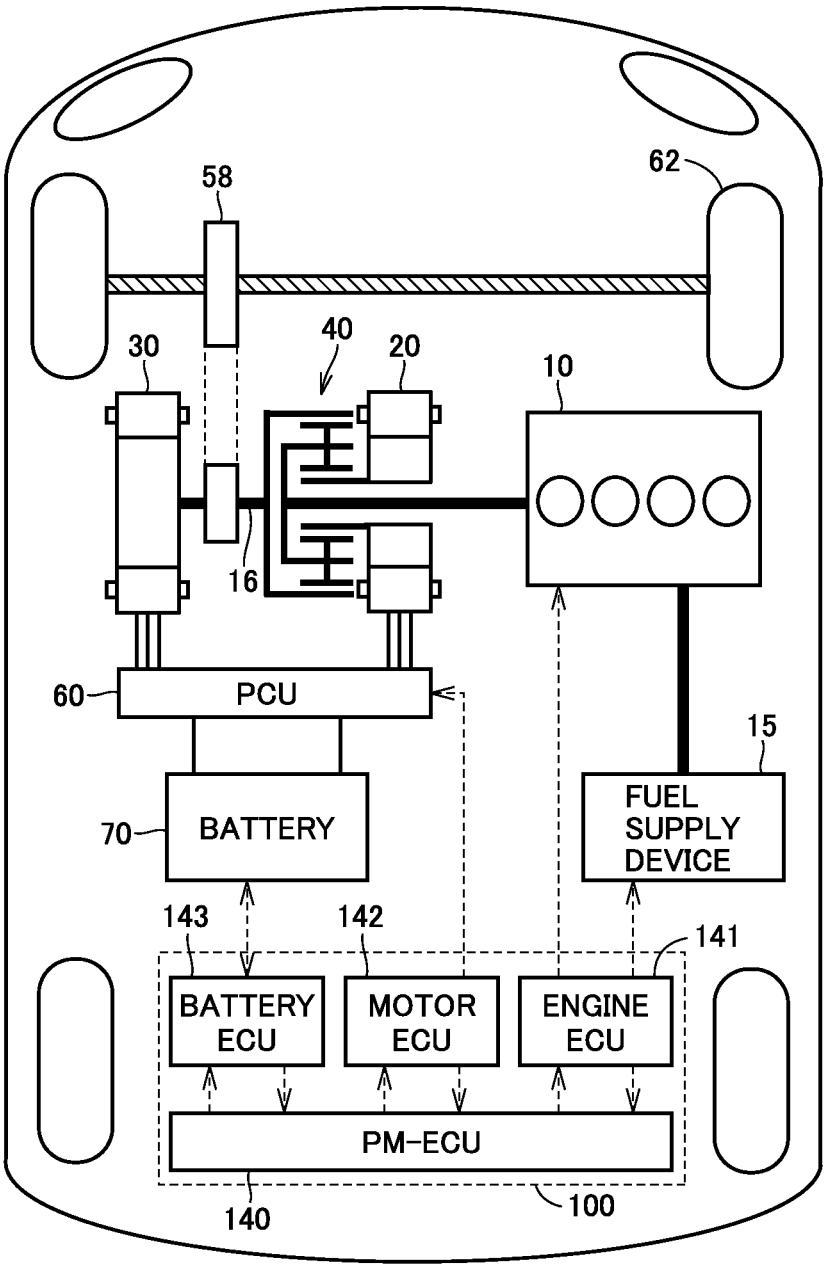
FIG. 1 is a block diagram showing the configuration of a hybrid vehicle 1 to which the present invention is applied.

Embodiments of the present invention will be described below in detail with reference to the drawings, in which the same or corresponding elements are designated by the same reference characters, and description thereof will not be repeated.

First Embodiment (Description of Basic Configuration)

FIG. 1 is a block diagram showing the configuration of hybrid vehicle 1 to which the present invention is applied. Referring to FIG. 1, hybrid vehicle 1 includes engine 10, fuel supply device 15, motor generators 20 and 30, a power split device 40, a reduction mechanism 58, a driving wheel 62, a power control unit (PCU) 60, a battery 70, and a control device 100.

Hybrid vehicle 1 is a series/parallel-type hybrid vehicle, and is configured to be capable of running using at least one of engine 10 and motor generator 30 as a driving source.

Engine 10, motor generator 20, and motor generator 30 are coupled to one another via power split device 40. Reduction mechanism 58 is connected to a rotation shaft 16 of motor generator 30, which is coupled to power split device 40. Rotation shaft 16 is coupled to driving wheel 62 via reduction mechanism 58, and is coupled to a crankshaft of engine 10 via power split device 40.

Power split device 40 is capable of splitting the driving force of engine 10 for motor generator 20 and rotation shaft 16. Motor generator 20 can function as a starter for starting engine 10 by rotating the crankshaft of engine 10 via power split device 40.

Motor generators 20 and 30 are both well-known synchronous generator motors that can operate both as power generators and electric motors. Motor generators 20 and 30 are connected to PCU 60, which in turn is connected to battery 70.

Control device 100 includes an electronic control unit for power management (hereinafter referred to as "PM-ECU") 140, an electronic control unit for the engine (hereinafter referred to as "engine ECU") 141, an electronic control unit for the motors (hereinafter referred to as "motor ECU") 142, and an electronic control unit for the battery (hereinafter referred to as "battery ECU") 143.

PM-ECU 140 is connected to engine ECU 141, motor ECU 142, and battery ECU 143, via a communication port (not shown). PM-ECU 140 exchanges various control signals and data with engine ECU 141, motor ECU 142, and battery ECU 143.

Motor ECU 142 is connected to PCU 60 to control driving of motor generators 20 and 30. Battery ECU 143 calculates a remaining capacitance (hereinafter referred to as SOC (State of Charge)), based on an integrated value of charge/discharge current of battery 70.

Engine ECU 141 is connected to engine 10 and fuel supply device 15. Engine ECU 141 receives input of signals from various sensors that detect an operation state of engine 10, and performs operation control such as fuel injection control, ignition control, intake air amount regulation control, and the like, in response to the input signals. Engine ECU 141 also controls fuel supply device 15 to supply fuel to engine 10.

In hybrid vehicle 1 having the above-described configuration, the configuration and control of engine 10 and fuel supply device 15 will be described in more detail.

Figure 2:
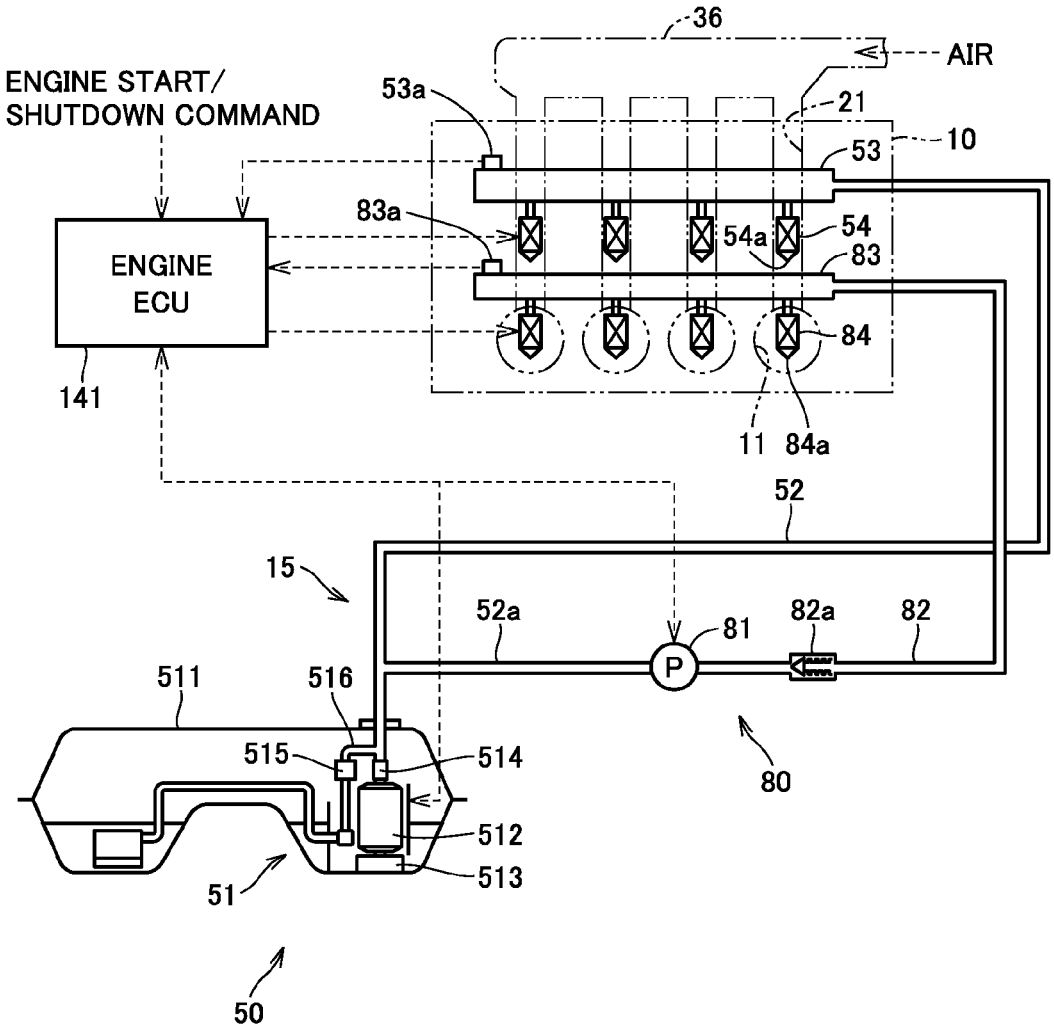
FIG. 2 is a diagram showing the configuration of an engine 10 and a fuel supply device 15 concerning fuel supply.

FIG. 2 is a diagram showing the configuration of engine 10 and fuel supply device 15 concerning fuel supply. In this embodiment, the vehicle to which the invention is applied is a hybrid vehicle that adopts, as an internal combustion engine, a dual injection-type internal combustion engine using both in-cylinder injection and port injection, for example, a serial four-cylinder gasoline engine.

Referring to FIG. 2, engine 10 includes an intake manifold 36, an intake port 21, and four cylinders 11 provided in a cylinder block.

When a piston (not shown) is lowered in each cylinder 11, intake air AIR flows into each cylinder 11 from an intake port pipe by way of intake manifold 36 and intake port 21.

Fuel supply device 15 includes a low-pressure fuel supply mechanism 50 and a high-pressure fuel supply mechanism 80. Low-pressure fuel supply mechanism 50 includes a fuel pumping section 51, a low-pressure fuel pipe 52, low-pressure delivery pipe 53, low-pressure fuel pressure sensor 53*a*, and port injection valves 54.

High-pressure fuel supply mechanism 80 includes a high-pressure pump 81, a check valve 82*a*, a high-pressure fuel pipe 82, a high-pressure delivery pipe 83, a high-pressure fuel pressure sensor 83*a*, and in-cylinder injection valves 84.

Each in-cylinder injection valve 84 is an injector for in-cylinder injection having an nozzle hole 84*a* exposed within the combustion chamber of each cylinder 11. During a valve-opening operation of each in-cylinder injection valve 84, fuel pressurized within high-pressure delivery pipe 83 is injected into combustion chamber 16 from nozzle hole 84*a* of in-cylinder injection valve 84.

Engine ECU 141 is configured to include a CPU (Central Processing Unit), a ROM (Read Only Memory), a RAM (Random Access Memory), an input interface circuit, an output interface circuit, and the like. Engine ECU 141 controls engine 10 and fuel supply device 15 in response to an engine start/shutdown command from PM-ECU shown in FIG. 1.

Engine ECU 141 calculates a fuel injection amount required for every combustion cycle based on the accelerator pedal position, the intake air amount, the engine speed, and the like. Engine ECU 141 also outputs an injection command signal or the like to each port injection valve 54 and each in-cylinder injection valve 84, at an appropriate time, based on the fuel injection amount calculated.

At the start of engine 10, engine ECU 141 causes port injection valves 54 to perform fuel injection first. ECU 140 then begins to output an injection command signal to each in-cylinder injection valve 84 when the fuel pressure within high-pressure delivery pipe 83 detected by high-pressure fuel pressure sensor 83*a* has exceeded a preset pressure value.

Furthermore, while engine ECU 141 basically uses in-cylinder injection from in-cylinder injection valves 84, for example, it also uses port injection under a specific operation state in which in-cylinder injection does not allow sufficient formation of an air-fuel mixture, for example, during the start and the warm-up of engine 10, or during rotation of engine 10 at low speed and high load. Alternatively, while engine ECU 141 basically uses in-cylinder injection from in-cylinder injection valves 84, for example, it also causes port injection from port injection valves 54 to be performed when port injection is effective, for example, during rotation of engine 10 at high speed and low load.

In this embodiment, fuel supply device 15 has a feature in that the pressure of low-pressure fuel supply mechanism 50 is variably controllable. Low-pressure fuel supply mechanism 50 of fuel supply device 15 will be described below in more detail.

Fuel pumping section 51 includes a fuel tank 511, a feed pump 512, a suction filter 513, a fuel filter 514, a relief valve 515, and a fuel pipe 516 connecting these components.

Fuel tank 511 stores a fuel consumed by engine 10, for example, gasoline. Suction filter 513 prevents suction of foreign matter. Fuel filter 514 removes foreign matter contained in discharged fuel.

Relief valve 515 opens when the pressure of the fuel discharged from feed pump 512 reaches an upper limit pressure, and remains closed while the pressure of the fuel is below the upper limit pressure.

Low-pressure fuel pipe 52 connects from fuel pumping section 51 to low-pressure delivery pipe 53. Note, however, that low-pressure fuel pipe 52 is not limited to a fuel pipe, and may also be a single member through which a fuel passage is formed, or may be a plurality of members having a fuel passage formed therebetween.

Low-pressure delivery pipe 53 is connected to low-pressure fuel pipe 52 on one end thereof in a direction of the arrangement of cylinders 11 in series. Port injection valves 54 are connected to low-pressure delivery pipe 53. Low-pressure delivery pipe 53 is equipped with low-pressure fuel pressure sensor 53*a* that detects an internal fuel pressure.

Each port injection valve 54 is an injector for port injection having a nozzle hole 54*a* exposed within intake port 21 corresponding to each cylinder 11. During a valve-opening operation of each port injection valve 54, fuel pressurized within low-pressure delivery pipe 53 is injected into intake port 21 from nozzle hole 54*a* of port injection valve 54.

Feed pump 512 is driven or stopped based on a command signal sent from engine ECU 141.

Feed pump 512 is capable of pumping up fuel from fuel tank 511, and pressurizing the fuel to a pressure in a certain variable range of less than 1 [MPa: megapascal], for example, and discharging the fuel. Feed pump 512 is also capable of changing the amount of discharge [$m^3$/sec] and the discharge pressure [kPa: kilopascal] per unit time, under the control of engine ECU 141.

This control of feed pump 512 is preferable in the following respects. Firstly, in order to prevent gasification of the fuel inside low-pressure delivery pipe 53 when the engine is heated to a high temperature, it is necessary to exert a pressure on low-pressure delivery pipe 53 beforehand such that the fuel does not gasify. An excessive pressure, however, will cause a great load on the pump, leading to a large energy loss. Since the pressure for preventing gasification of the fuel changes depending on the temperature, energy loss can be reduced by exerting a required pressure on low-pressure delivery pipe 53. Secondly, wasteful consumption of energy for pressurizing the fuel can be reduced by controlling feed pump 512 appropriately to deliver an amount of fuel corresponding to an amount of fuel consumed by the engine. This is advantageous in that the fuel efficiency is improved over a configuration in which the fuel is excessively pressurized, and then the fuel pressure is adjusted to be constant with a pressure regulator.

In the variable fuel-pressure control by feed pump 512, it is necessary to ensure the reliability of a detection value of low-pressure fuel pressure sensor 53*a* provided on low-pressure delivery pipe 53 that stores fuel for performing port injection. Thus, the stuck detection of a detection value of low-pressure fuel pressure sensor 53*a* as described above is regularly performed.

(Explanation of Stuck Detection Control)

The stuck detection is a failure detection to check whether the detection value of low-pressure fuel pressure sensor 53*a* has not become a fixed value. In order to check whether the detection value of low-pressure fuel pressure sensor 53*a* changes, it is necessary to check detection values of low-pressure fuel pressure sensor 53*a* at at least two pressures.

This stuck detection is preferably performed at an early stage before, for example, the state in which there is a deviation in air-fuel ratio due to an abnormality in low-pressure fuel pressure sensor 53*a* continues.

The timing and pressure conditions for performing the stuck detection are important, in order to control fuel supply device 15 having the above-described structure so as to complete the stuck detection of low-pressure fuel pressure sensor 53*a* at an early stage. In this embodiment, the stuck detection of low-pressure fuel pressure sensor 53*a* is performed by changing the pressure using a predetermined procedure. Specifically, in accordance with the waveform shown below, first processing is performed which includes increasing the fuel pressure to a pressure higher than that during normal use after the start of the engine, and then reading a value of the fuel pressure sensor, and then second processing is performed which includes reducing the fuel pressure, and reading a value of the fuel pressure sensor.

Figure 3:
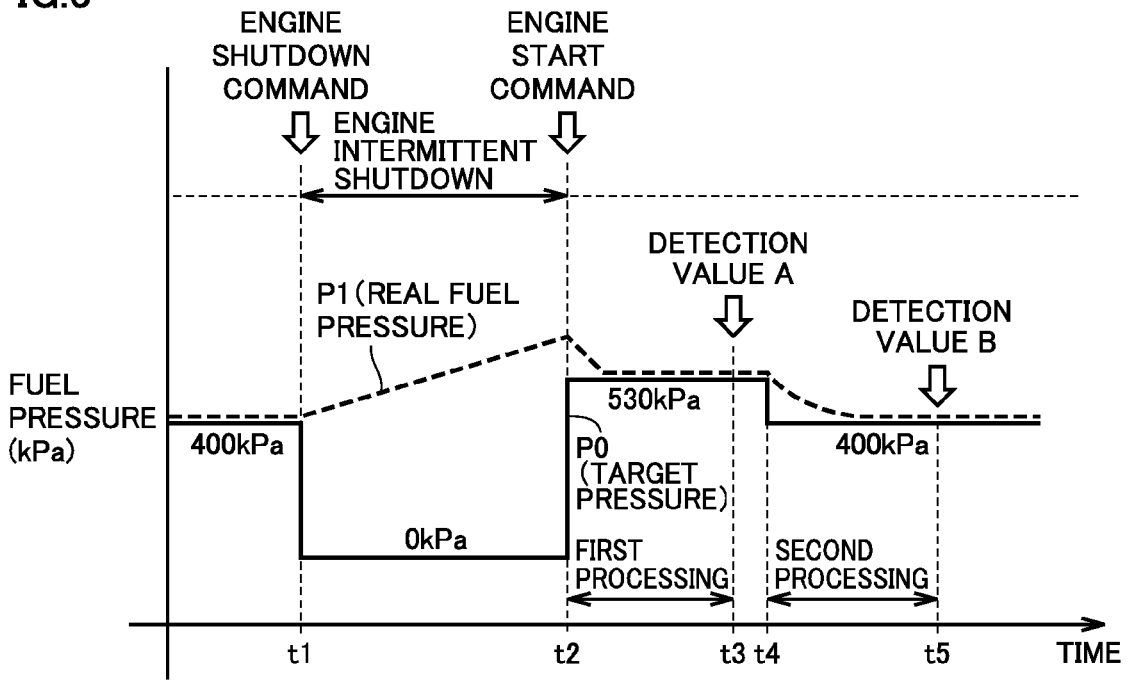
FIG. 3 is a waveform diagram showing one example of a change in fuel pressure when processing of a first embodiment is performed.

FIG. 3 is a waveform diagram showing one example of a change in fuel pressure when the processing according to the first embodiment is performed.

Referring to FIG. 3, at time t1, if engine 10 is in operation, an engine shutdown command is output from PM-ECU 140, in response to which engine ECU 141 causes the engine to be shut down. At this time, target fuel pressure P0 is set to 0 [kPa]. Real fuel pressure P1, however, may increase from 400 [kPa] during an engine intermittent shutdown period between times t1 and t2. This increase in fuel pressure will be briefly described, referring to a schematic representation.

Figure 4:
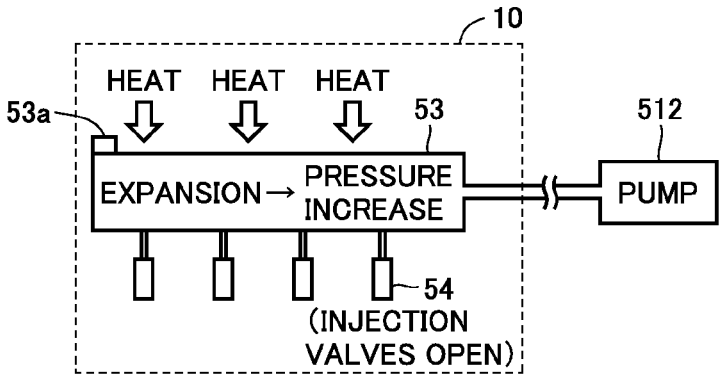
FIG. 4 is a schematic diagram of a low-pressure delivery pipe 53.

FIG. 4 is a schematic diagram of low-pressure delivery pipe 53. Referring to FIG. 4, low-pressure delivery pipe 53 serving as a storage section that stores the pressurized fuel is basically in a sealed state while engine 10 is shut down. While engine 10 is shut down, fuel exchange involving the discharge of the fuel from port injection valves 54 and the supply of fresh fuel from feed pump 512 does not occur in low-pressure delivery pipe 53. The fuel confined within low-pressure delivery pipe 53 expands due to the influence of the heat of engine 10, which causes the pressure inside low-pressure delivery pipe 53 to increase. Thus, while engine 10 is shut down, real fuel pressure P1 supplied to low-pressure fuel pressure sensor 53*a* is not constant because it is influenced by the temperature of engine 10. For example, if intermittent operation of engine 10 occurs in the state in which engine 10 is sufficiently warmed, the fuel pressure increases due to the influence of the heat from engine 10 during shutdown.

In such a situation, if the stuck detection of the fuel pressure sensor is attempted in a manner other than that shown in FIG. 3, for example, by changing the fuel pressure from a low pressure (400 [kPa]) to a high pressure (530 [kPa]), it is necessary to reduce the previously increased fuel pressure to a low pressure. Since port injection valves 54 basically serve as the only discharge path of the fuel from low-pressure delivery pipe 53, there is nothing but to operate engine 10 and wait until the fuel pressure decreases to 400 [kPa]. If the fuel pressure is higher than 530 [kPa], waiting until the fuel pressure decreases to 400 [kPa] will make the stuck detection time-consuming. In contrast, a fuel pressure that is still low at the start of the engine can be readily increased by rotating feed pump 512 at the maximum rotation speed, with relatively high responsibility. The fuel pressure can also be increased prior to the issuance of an engine start command.

For the above reason, in this embodiment, as shown in FIG. 3, the first processing is performed which includes setting a high target fuel pressure (530 [kPa]) between times t2 and t3, and obtaining a detection value A, and then the second processing is performed which includes reducing the target fuel pressure, setting a low target fuel pressure (400 [kPa]) between times t4 and t5, and obtaining a detection value B. As shown in FIG. 3, when the fuel pressure is higher than real fuel pressure P1 [kPa] at time t2, the first processing in which the target value of fuel pressure is set to 530 [kPa] may be initiated. This allows the stuck detection to begin at an earlier stage than performing the second processing first in which the target value of fuel pressure is set to 400 [kPa], by an amount of time required for the fuel pressure to decrease from 530 [kPa] to 400 [kPa].

Thus, the control according to this embodiment allows the stuck detection to be completed at an early stage when real fuel pressure P1 is high between times t1 and t2 shown in FIG. 3.

Figure 5:
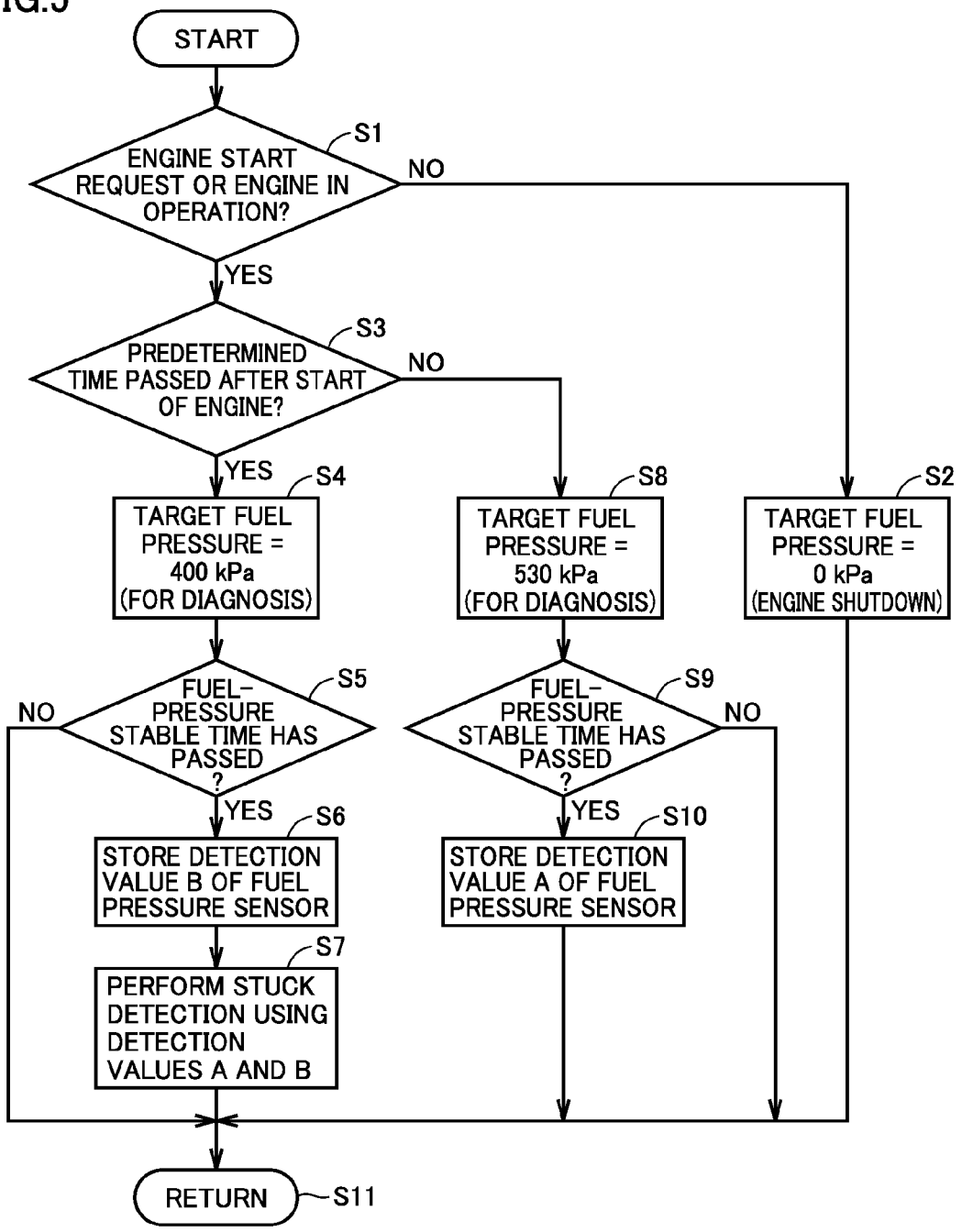
FIG. 5 is a flowchart for explaining stuck detection processing of a low-pressure fuel pressure sensor 53*a* performed in the first embodiment.

FIG. 5 is a flowchart for explaining stuck detection processing of low-pressure fuel pressure sensor 53*a* performed in the first embodiment. The flowchart shown in FIG. 5 is invoked from a main routine at every constant period or every time a predetermined condition is established, and then executed. First, in step S1, engine ECU 141 determines whether or not there is an engine start request from PM-ECU 140, or the engine is in operation. In step S1, if there is no engine start request, and the engine is not in operation (NO in S1), the processing proceeds to step S2.

In step S2, the target fuel pressure of low-pressure delivery pipe 53 is set to 0 [kPa]. After the completion of the processing of step S2, the control is returned to the main routine in step S11.

On the other hand, if there is an engine start request, or the engine is in operation (YES in S1), the processing proceeds to step S3. In step S3, it is determined whether or not a predetermined time has passed after the start of the engine.

If a predetermined time has not passed in step S3 (NO in S3), the processing proceeds to step S8 where the target fuel pressure of low-pressure delivery pipe 53 is set to 530 [kPa]. The target fuel pressure of 530 [kPa] is a diagnostic fuel pressure set to be higher than a normally used fuel pressure, for the stuck detection of the fuel pressure sensor.

Subsequent to the processing of step S8, it is determined in step S9 whether or not a preset fuel-pressure stable time has passed. If the fuel-pressure stable time has not passed (NO in S9), the processing proceeds to step S11, and then the processing of this flowchart is performed again from step S1. Consequently, waiting time is required until the fuel-pressure stable time passes. If the fuel-pressure stable time has passed, and the fuel pressure has stabilized in step S9 (YES in S9), the processing proceeds to step S10.

In step S10, engine ECU 141 stores detection value A detected by low-pressure fuel pressure sensor 53*a*. Then, the processing proceeds to step S11 where the control is returned to the main routine once.

On the other hand, if a predetermined time has passed after the start of the engine in step S3 (YES in S3; after the completion of the processing of steps S8 to S10), the processing proceeds to step S4. In step S4, the target fuel pressure of low-pressure delivery pipe 53 is set to 400 [kPa]. In this embodiment, the target fuel pressure of 400 [kPa] is a fuel pressure equal to a fuel pressure during normal operation in which the stuck detection has not been performed. Note that the target fuel pressure may not be equal to a fuel pressure during normal operation, so long as it is set to be lower than the diagnostic fuel pressure set in step S8.

Subsequent to the processing of step S4, it is determined in step S5 whether or not a preset fuel-pressure stable time has passed. If the fuel-pressure stable time has not passed (NO in S5), the processing proceeds to step S11, and then the processing of this flowchart is performed again from step S1. Consequently, waiting time is required until the fuel-pressure stable time passes. If the fuel-pressure stable time has passed, and the fuel pressure has stabilized in step S5 (YES in S5), the processing proceeds to step S6.

In step S6, engine ECU 141 stores detection value B detected by low-pressure fuel pressure sensor 53*a*. The flowchart then proceeds to step S7 where a stuck failure diagnosis of low-pressure fuel pressure sensor 53*a* is performed, using detection value A previously stored in step S10 and detection value B stored in step S6. If detection value A is around 530 [kPa], and detection value B is around 400 [kPa], low-pressure fuel pressure sensor 53*a* is in a normal state. If detection values A and B are equal, engine ECU 141 determines that low-pressure fuel pressure sensor 53*a* has a stuck failure. Note that the processing of step S7 need not be performed constantly during the engine operation, and may be performed once for one occurrence of engine start. After the completion of the stuck detection in step S7, the processing proceeds to step S11 where the control is returned to the main routine.

Referring to FIGS. 3 and 5, the relationship between the flowchart and the waveform will be briefly described. At time t1, if engine 10 is in operation, an engine shutdown command is output from PM-ECU 140, in response to which engine ECU 141 causes the engine to be shut down. At this time, in the flowchart of FIG. 5, target fuel pressure P0 is set to 0 [kPa] in step S2.

Between times t2 and t3, the first processing is performed in which a high target fuel pressure (530 [kPa]) is set, and detection value A is obtained. In FIG. 5, the first processing is performed from steps S8 to S10.

The target fuel pressure is then reduced, and between times t4 and t5, the second processing is performed in which a low target fuel pressure (400 [kPa]) is set, and detection value B is obtained. In FIG. 5, the first processing is performed from steps S5 to S7.

As described above, in the first embodiment, the stuck detection is performed by changing the target pressure from a high pressure to a low pressure, which allows the stuck detection to be completed at an early stage when real fuel pressure P1 is high between times t1 and t2 shown in FIG. 3.

Second Embodiment

In the second embodiment, an example will be described where the fuel efficiency is improved over the first embodiment, while ensuring the reliability of the fuel pressure sensor by performing the stuck detection processing of the first embodiment.

In the stuck detection processing, a fuel pressure higher than that used during normal running is generated in feed pump 512. It is more advantageous not to perform this processing, where not required, in terms of improving the fuel efficiency. In the second embodiment, a stuck detection completion flag F1 is introduced to perform control such that the stuck detection is not performed after it has been performed a required number of times.

Figure 6:
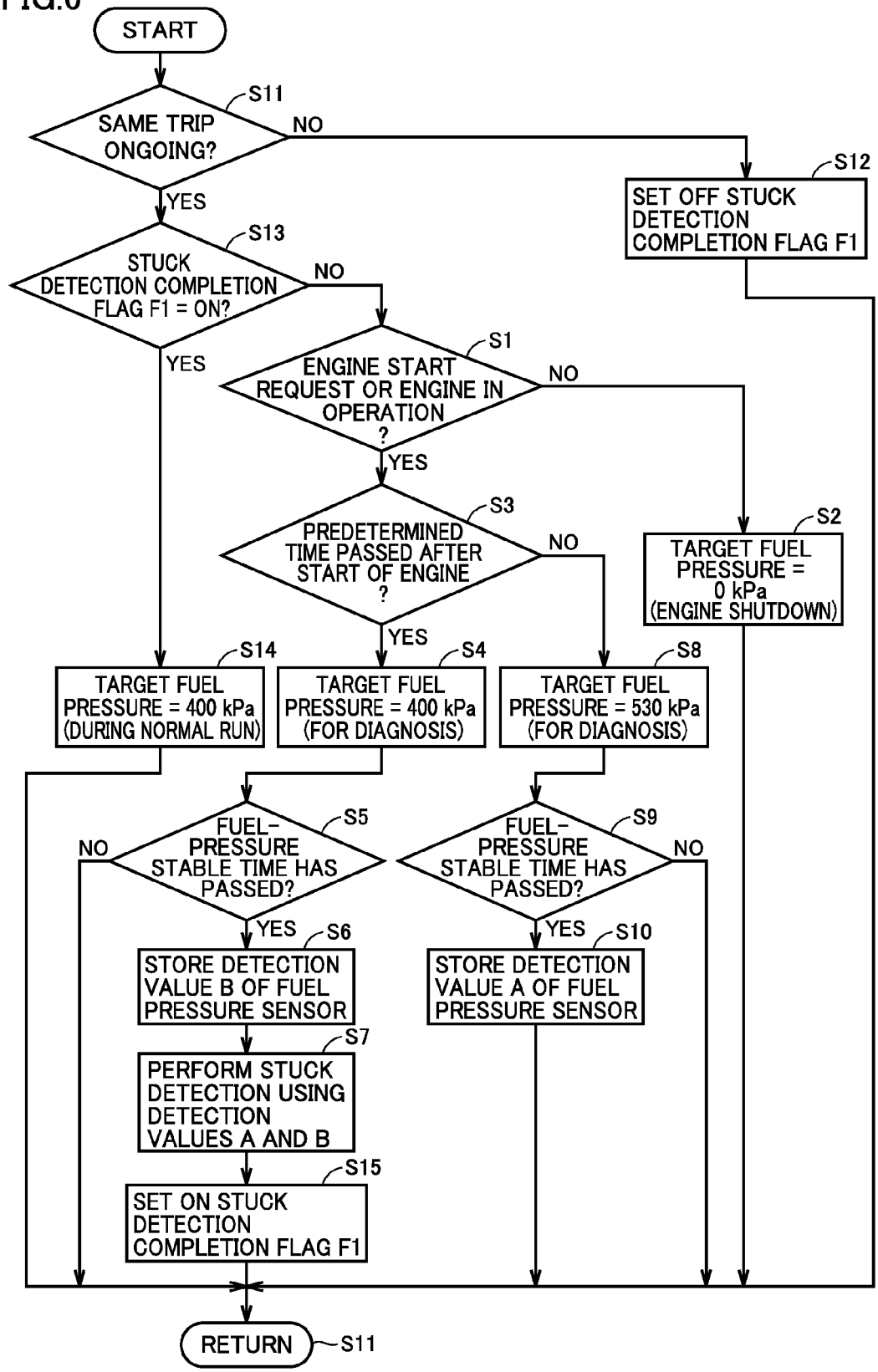
FIG. 6 is a flowchart showing control of the stuck detection performed in a second embodiment.

FIG. 6 is a flowchart showing the control of the stuck detection performed in the second embodiment. Note that the configuration shown in FIGS. 1 and 2 is also the same in the second embodiment. The flowchart of FIG. 6 includes additional steps S11 to S15 in the flowchart of the first embodiment shown in FIG. 5. The processing of steps S1 to S11, which has been described in the first embodiment, will not be repeated here.

Referring to FIG. 6, it is determined in step S11 whether or not the same trip is ongoing. One round of trip refers to the time between when a user rides in the vehicle, inserts a vehicle key, and starts the vehicle, and when the user reaches a destination, parks the vehicle, removes the vehicle key, and gets out of the vehicle.

In the second embodiment, stuck detection completion flag F1 is used in the fuel pressure control for the vehicle. Stuck detection completion flag F1 is set OFF until the stuck detection is performed a required number of times (five times, for example) in one round of trip. Stuck detection completion flag F1 is set ON after the stuck detection has been performed the required number of times.

In step S11, if the same trip is not ongoing (NO in S 11), the processing proceeds to step S12 where engine ECU 141 initializes stuck detection completion flag F1, and sets OFF stuck detection completion flag F1. Then in step S11, the control is returned to the main routine.

In step S11, if the same trip is ongoing (YES in S11), the processing proceeds to step S13 where engine ECU 141 determines whether or not stuck detection completion flag F1 is ON. In step S13, if stuck detection completion flag F1 is OFF (NO in S13), the processing proceeds to step S1 where the stuck detection processing is thereafter performed as in the first embodiment. At this time, if, in step S15 subsequent to step S7, engine ECU 141 has monitored whether or not the required number of times of the stuck detection has been completed, and if so, stuck detection completion flag F1 is set ON.

On the other hand, if in step S13, stuck detection completion flag F1 is ON (NO in S11), the processing proceeds to step S14. In step S14, the target fuel pressure is set to 400 [kPa], and then the processing proceeds to step S11. Thereafter, the stuck detection is not performed until the trip ends.

As described above, after start of the vehicle, and after the control device has performed the first processing and the second processing in response to an engine start signal a number of times required for the stuck detection of low-pressure fuel pressure sensor 53*a*, engine ECU 141 sets ON stuck detection completion flag F1, and does not cause the stuck detection to be performed even if an engine start signal is detected.

In the stuck detection processing, a fuel pressure higher than that used during normal running is generated in feed pump 512. It is more advantageous not to perform this processing, where not required, in terms of improving the fuel efficiency. In the second embodiment, the stuck detection is not performed after the stuck detection has been performed a required number of times. This is advantageous in terms of improving the fuel efficiency.

Third Embodiment

In a hybrid vehicle, the engine may be frequently started or shut down in response to a change in the magnitude of required power or a variation in the state of the SOC of the battery. Thus, even if the stuck detection processing of the first or second embodiment is initiated, if the engine is shut down, the stuck detection processing may not be completed. In the third embodiment, therefore, an example will be described where intermittent operation of the engine of a hybrid vehicle is prohibited so as to prevent an interruption of the stuck detection processing once the stuck detection processing is initiated.

Figure 7:
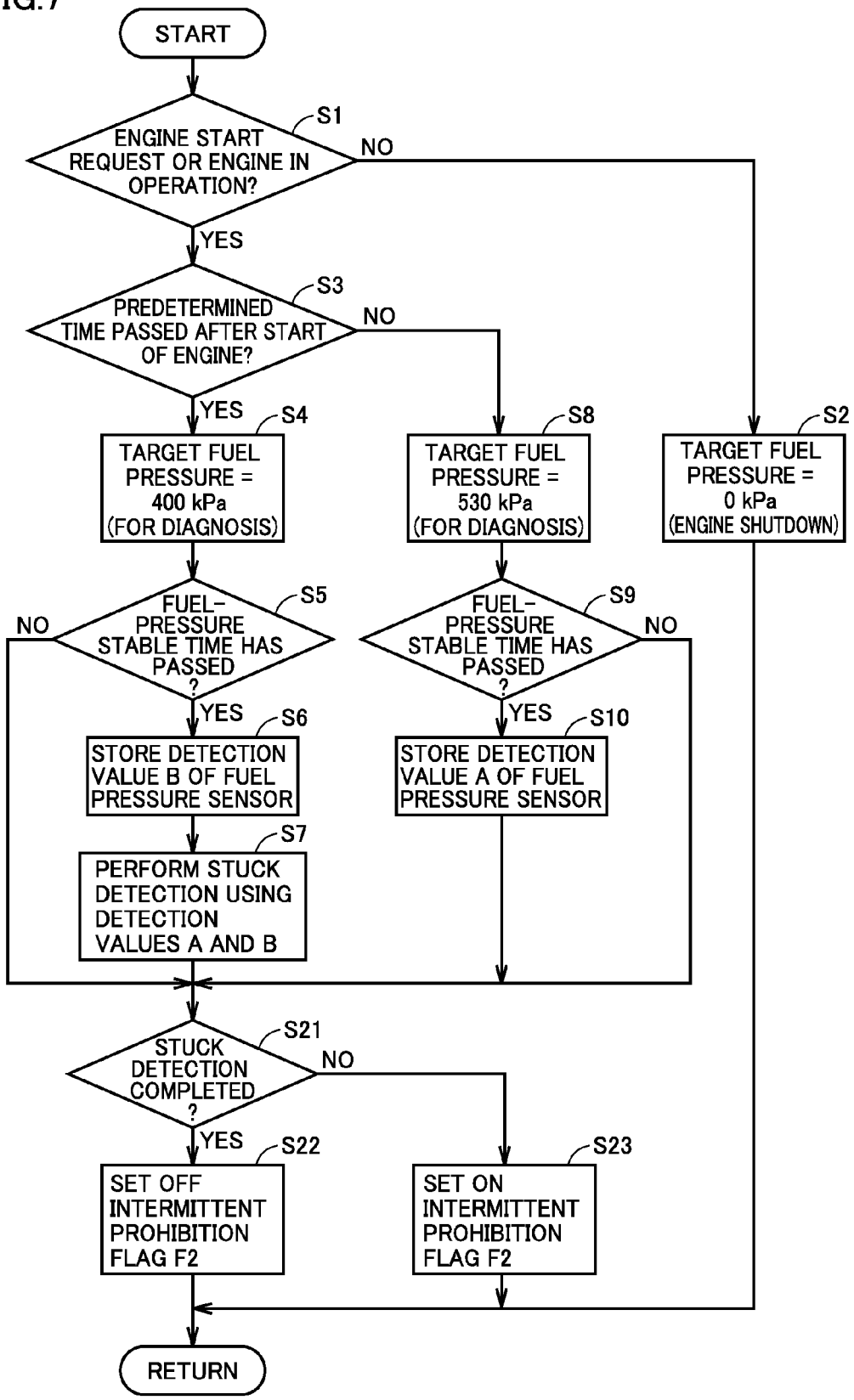
FIG. 7 is a flowchart showing control of the stuck detection performed in a third embodiment.

FIG. 7 is a flowchart showing control of the stuck detection performed in the third embodiment. Note that the configuration shown in FIGS. 1 and 2 is also the same in the third embodiment. The flowchart of FIG. 7 includes additional steps S21 to S23 in the flowchart of the first embodiment shown in FIG. 5. The processing of steps S1 to S10, which has been described in the first embodiment, will not be repeated here.

The processing in FIG. 7 proceeds to step S21, after the completion of the processing that is performed if there is an engine start request, or the engine is in operation, in step Si of the flowchart of the first embodiment shown in FIG. 5. Specifically, the processing proceeds to step S21 if the fuel-pressure stable time has not passed in step S5 (NO in S5), if the stuck detection is performed in S7, if the fuel-pressure stable time has not passed in step S9 (NO in S9), and if detection value A of the fuel pressure sensor is stored in step S10.

In step S21, engine ECU 141 determines whether or not one round of the stuck detection has been completed, that is, whether the first processing and the second processing have been completed in FIG. 3. If it is determined in step S21 that the stuck detection has been completed (YES in S21), in step S22, engine ECU 141 sets OFF an intermittent prohibition flag F2 that prohibits intermittent operation of engine 10. When intermittent prohibition flag F2 is set OFF, intermittent operation of engine 10 is permitted, which allows the engine to start or be shut down in response to a change in the magnitude of required power or a variation in the state of the SOC of the battery.

On the other hand, if it is determined in step S21 that the stuck detection has not been completed (NO in S21), engine ECU 141 sets ON intermittent prohibition flag F2 in step S23. When intermittent prohibition flag F2 is set ON, intermittent operation of engine 10 is prohibited. Thus, once the engine is started, the engine is kept in operation, even if there is a change in the magnitude of requested power or in the state of the SOC of the battery. This prevents the engine from being shut down in the course of the stuck detection. Then, in the determination cycle thereafter, if the stuck detection is completed (YES in S21), engine ECU 141 sets OFF intermittent prohibition flag F2 that prohibits intermittent operation of engine 10, so as to permit intermittent operation of engine 10.

As described above, since the engine is not shut down between times t2 and t5 in FIG. 3, the possibility that the stuck detection will be successfully completed can be increased.

As described above, in the third embodiment, engine ECU 141 causes the internal combustion engine to operate in the first processing and the second processing shown in FIG. 3. Once the first processing is initiated in response to an engine start command, engine ECU 141 prohibits shutdown of the internal combustion engine until the second processing is completed.

In a hybrid vehicle, during normal running, the engine may be frequently operated or shut down for improved fuel efficiency. In the configuration of the third embodiment, when the stuck detection processing is initiated, shutdown of engine 10 is prohibited until the processing is completed. This allows the stuck detection to be performed reliably in a hybrid vehicle.

In the third embodiment, the example has been described where intermittent prohibition flag F2 is introduced, as shown in FIG. 7, to the flowchart of the first embodiment. However, intermittent prohibition flag F2 may be introduced in addition to stuck detection completion flag F1 of the second embodiment.

Furthermore, although the internal combustion engine having the in-cylinder injection valves and the port injection valves is shown in FIG. 2 by way of example, the present invention is also applicable to an internal combustion engine only with port injection valves without in-cylinder injection valves.

While embodiments of the present invention have been described as above, it should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

What is claimed is:

1. A control device for an internal combustion engine, said internal combustion engine comprising:

a port injection valve that injects fuel into an intake passage;

a storage section that stores the fuel to be injected from said port injection valve; and a feed pump that pressurizes and supplies the fuel to said storage section, said control device comprising:

a fuel pressure sensor that detects a pressure of the fuel stored in said storage section; and a control unit that controls said feed pump based on a detection value of said fuel pressure sensor, and performs an abnormality diagnosis of said fuel pressure sensor based on a detection value of said fuel pressure sensor when a target pressure of the fuel stored in said storage section is changed, said control unit being configured to cause first processing to be performed in response to a start signal that starts said internal combustion engine, for changing said target pressure, and cause the second processing to be performed subsequent to said first processing, said first processing including setting the target pressure of the fuel in said storage section to a first pressure, pressurizing the fuel with said feed pump, and detecting a pressure of the fuel with said fuel pressure sensor, and said second processing including setting the target pressure of the fuel in said storage section to a second pressure lower than said first pressure, causing the fuel to be pressurized with said feed pump and reducing the pressure of the fuel by injection from said port injection valve of said internal combustion engine, and detecting a pressure of the fuel with said fuel pressure sensor.

2. The control device for an internal combustion engine according to claim 1, wherein said internal combustion engine is mounted on a hybrid vehicle configured to be capable of running while said internal combustion engine is shut down, and said start signal includes a signal generated when said internal combustion engine in a shutdown state is started while the vehicle is running.

3. The control device for an internal combustion engine according to claim 2, wherein said control device causes said internal combustion engine to operate in said second processing, and once said control device initiates said first processing in response to said start signal, said control device prohibits shutdown of said internal combustion engine until said second processing is completed.

4. The control device for an internal combustion engine according to claim 2, wherein after start of the vehicle, and after said control device has performed said first processing and said second processing in response to said start signal a number of times required for the abnormality diagnosis of said fuel pressure sensor, said control device does not perform said first processing even if said start signal is detected.

5. The control device for an internal combustion engine according to claim 1, wherein said internal combustion engine further comprises:

an in-cylinder injection valve that injects the fuel into a cylinder;

a high-pressure storage section that stores the fuel to be injected from said in-cylinder injection valve; and a high-pressure pump that pressurizes and supplies the fuel to said high-pressure storage section, wherein a pressure of said storage section is set to be lower than a pressure of said high-pressure storage section.

* * * * *